US009776186B2

(12) United States Patent
Esterberg et al.

(10) Patent No.: US 9,776,186 B2
(45) Date of Patent: Oct. 3, 2017

(54) RESERVOIR WITH VARIABLE RADIUS FILLET

(71) Applicant: Hewlett-Packard Development Company, L.P., Houston, TX (US)

(72) Inventors: Dennis R Esterberg, Philomath, OR (US); Frank D Derryberry, Corvallis, OR (US); Richard W Seaver, Corvallis, OR (US); Christie Dudenhoefer, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 290 days.

(21) Appl. No.: 14/654,706

(22) PCT Filed: Jan. 8, 2013

(86) PCT No.: PCT/US2013/020704
§ 371 (c)(1),
(2) Date: Jun. 22, 2015

(87) PCT Pub. No.: WO2014/109733
PCT Pub. Date: Jul. 17, 2014

(65) Prior Publication Data

US 2015/0336100 A1 Nov. 26, 2015

(51) Int. Cl.
*B01L 3/00* (2006.01)
*B41J 2/175* (2006.01)

(52) U.S. Cl.
CPC ..... *B01L 3/527* (2013.01); *B01L 3/52* (2013.01); *B41J 2/1752* (2013.01); *B41J 2/17553* (2013.01); *B01L 2200/16* (2013.01)

(58) Field of Classification Search
CPC ..... B01L 3/527; B01L 3/52; B01L 2200/16; B41J 2/17553; B41J 2/1752
See application file for complete search history.

(56) References Cited

U.S. PATENT DOCUMENTS

| | | | |
|---|---|---|---|
| 4,067,071 A | 1/1978 | Altman et al. | |
| 4,791,438 A | 12/1988 | Hanson et al. | |
| 5,971,527 A | 10/1999 | Peeters et al. | |
| 6,513,903 B2 | 2/2003 | Sharma et al. | |
| 7,879,621 B2 | 2/2011 | Gjerde et al. | |
| 7,951,611 B2 | 5/2011 | Kopaciewicz et al. | |
| D655,423 S * | 3/2012 | Nielsen | D24/216 |
| 8,550,301 B2 | 10/2013 | Szymanski | |

(Continued)

FOREIGN PATENT DOCUMENTS

| | | |
|---|---|---|
| CN | 101284639 | 10/2008 |
| CN | 101439779 | 5/2009 |
| WO | WO-2007087449 | 8/2007 |

OTHER PUBLICATIONS

International Search Report and Written Opinion, Sep. 24, 2013, PCT Patent Application No. PCT/US2013/020704, KIPO.

*Primary Examiner* — Dennis M White
(74) *Attorney, Agent, or Firm* — HP Inc. Patent Department

(57) ABSTRACT

A slot extender includes a reservoir. The reservoir includes a reservoir floor defining a drain opening, a continuous reservoir sidewall extending from the reservoir floor, and a concave fillet running along at least a portion where the reservoir sidewall joins the reservoir floor. The concave fillet has a variable radius.

15 Claims, 7 Drawing Sheets

(56) References Cited

U.S. PATENT DOCUMENTS

| | | | |
|---|---|---|---|
| 2002/0094304 | A1 | 7/2002 | Yang et al. |
| 2006/0192815 | A1 | 8/2006 | Donaldson et al. |
| 2010/0261611 | A1 | 10/2010 | Peters |
| 2010/0277554 | A1 | 11/2010 | Sulser et al. |
| 2010/0304496 | A1 | 12/2010 | Nielsen et al. |
| 2011/0025782 | A1 | 2/2011 | Haluzak et al. |
| 2011/0121095 | A1 | 5/2011 | Crichton et al. |
| 2012/0051984 | A1 | 3/2012 | Dudenhoefer et al. |
| 2012/0079652 | A1 | 4/2012 | Lemire et al. |
| 2012/0132696 | A1 | 5/2012 | Camp |

* cited by examiner

RESERVOIR WITH VARIABLE RADIUS FILLET

CROSS-REFERENCE TO RELATED APPLICATION

This application is a U.S. National Stage Application of and claims priority to International Patent Application No. PCT/US2013/020704, filed on Jan. 8, 2013, and entitled "RESERVOIR WITH VARIABLE RADIUS FILLET," which is hereby incorporated by reference in its entirety.

BACKGROUND

Dispensing liquids in quantities from picoliters to microliters is an essential operation in many areas of pharmaceutical and biology research, as well as in medical and veterinary diagnostics, forensics testing, and agricultural testing. Even within these fields, low-volume liquid dispensing is used for many different operations.

One stage of pharmaceutical research, during which low-volume liquid dispensing is important, is directed to determining the concentration of a compound needed to effectively attack or inhibit a target (e.g., a virus). These are generally called dose-response experiments. Many different concentrations of the compound are created in containers, such as wells of a well plate, to determine the effective concentration. Dispensing systems direct liquids into the wells.

BRIEF DESCRIPTION OF THE DRAWINGS

In the drawings.

Use of the same reference numbers in different figures indicates similar or identical elements.

DETAILED DESCRIPTION

As used herein, the term "includes" means includes but not limited to, the term "including" means including but not limited to. The terms "a" and "an" are intended to denote at least one of a particular element.

Liquid Dispenser Cassette

A digital dispenser is an apparatus that utilizes dispense heads based on inkjet technology to accurately apportion picoliter to microliter doses of compounds into wells on a well plate. In operation, the digital dispenser is loaded with a cassette and a technician pipets samples into reservoirs on the cassette. Under software control, the digital dispenser dispenses predetermined amounts of the samples into the wells.

Researchers may mix an active compound with a liquid medium such as a solvent, a filler, or a carrier. An example of a solvent is dimethyl sulfoxide (DMSO). This liquid solution is placed into a dispense head on a cassette and digitally dispensed into wells of a well plate. In a research experiment, different amounts of the active compound mixed with the liquid medium may be dispensed into each of the wells. This causes the amount of the liquid medium in each well to be different. Thus a "normalization" step may be employed to equalize the amount of the liquid medium dispensed into each well. In this normalization step, a complimentary quantity of the liquid medium is added to each well of the experiment, such that the total quantity of the liquid medium in each experimental well is equal. An equal amount of the liquid medium in the wells allows the researchers to see only the effect of the active compound instead of the variation in the liquid medium. As experiments may be designed on a logarithmic scale, the amount of the liquid medium required to normalize a well plate may be quite large.

In examples of the present disclosure, a liquid dispenser cassette is provided to normalize wells. The cassette may have less than eight dispense heads and at least a one-piece integrated slot extender having multiple reservoirs for the dispense heads. By reducing the number of dispense heads, the volume of the reservoirs may be increased to handle normalization and the cost of the cassette may be reduced. By integrating multiple reservoirs into a single slot extender, they may be better aligned with the other components of the cassette.

Figure 1:
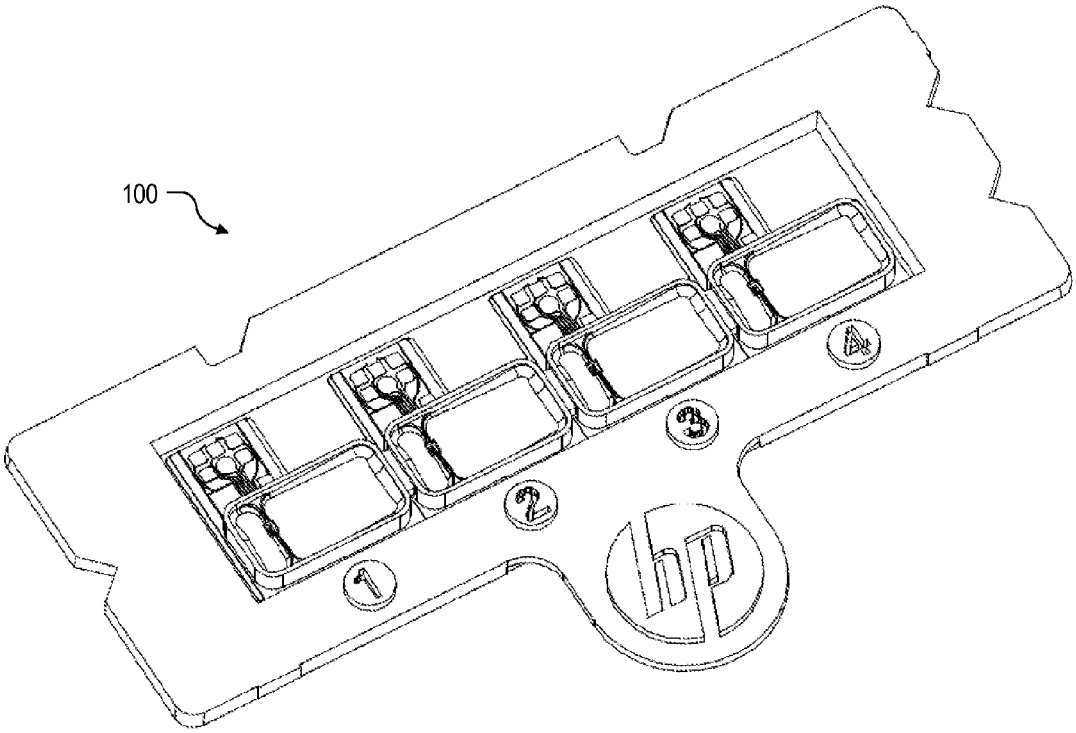
FIG. 1 is a perspective view of a liquid dispenser cassette in one example of the present disclosure.
Figure 2:
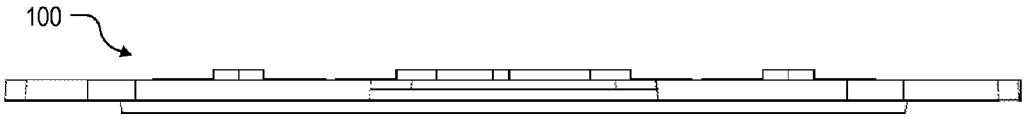
FIG. 2 is a front view of the cassette of FIG. 1 in one example of the present disclosure.
Figure 3:
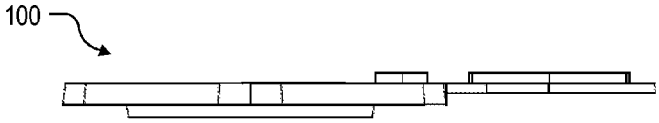
FIG. 3 is a left side view of the cassette of FIG. 1 in one example of the present disclosure.
Figure 4:
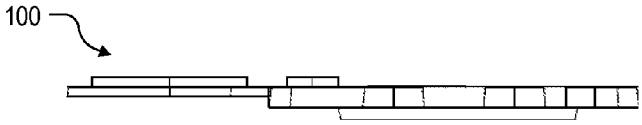
FIG. 4 is a right side view of the cassette of FIG. 1 in one example of the present disclosure.
Figure 5:
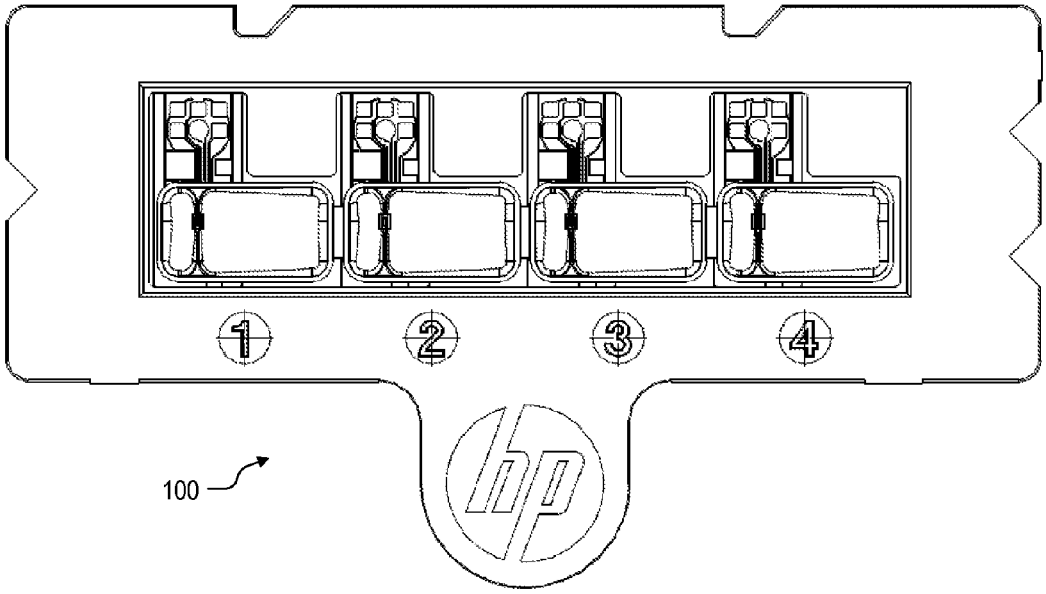
FIG. 5 is a top view of the cassette of FIG. 1 in one example of the present disclosure.
Figure 6:
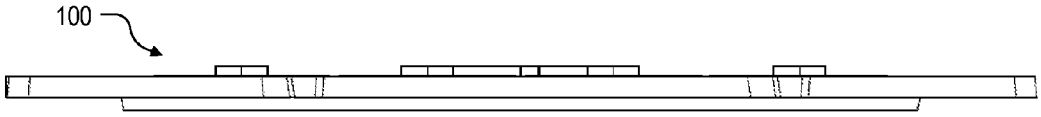
FIG. 6 is a rear view of the cassette of FIG. 1 in one example of the present disclosure.
Figure 7:
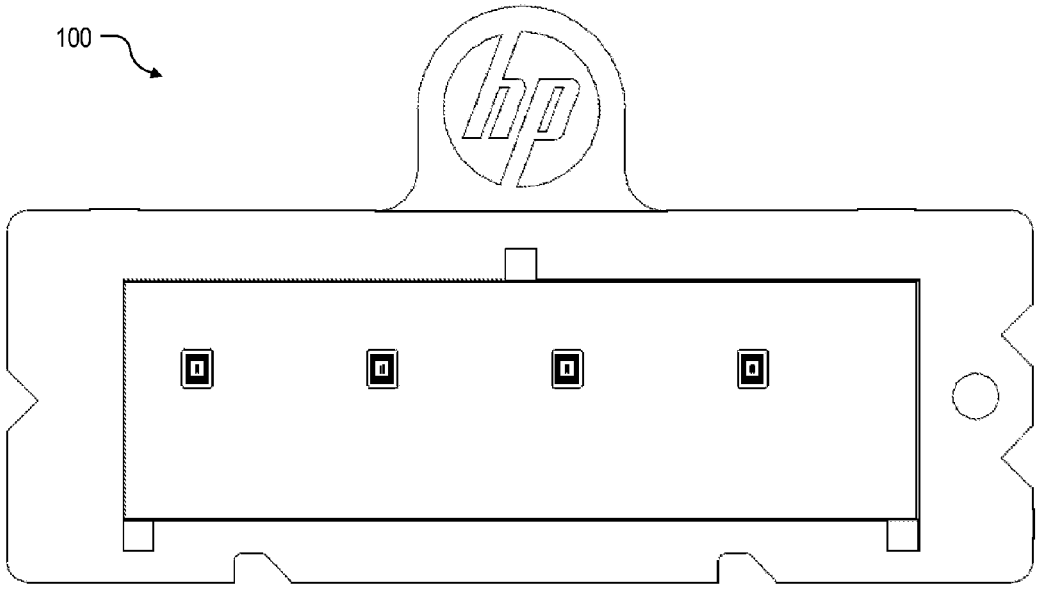
FIG. 7 is a bottom view of the cassette of FIG. 1 in one example of the present disclosure.
Figure 8:
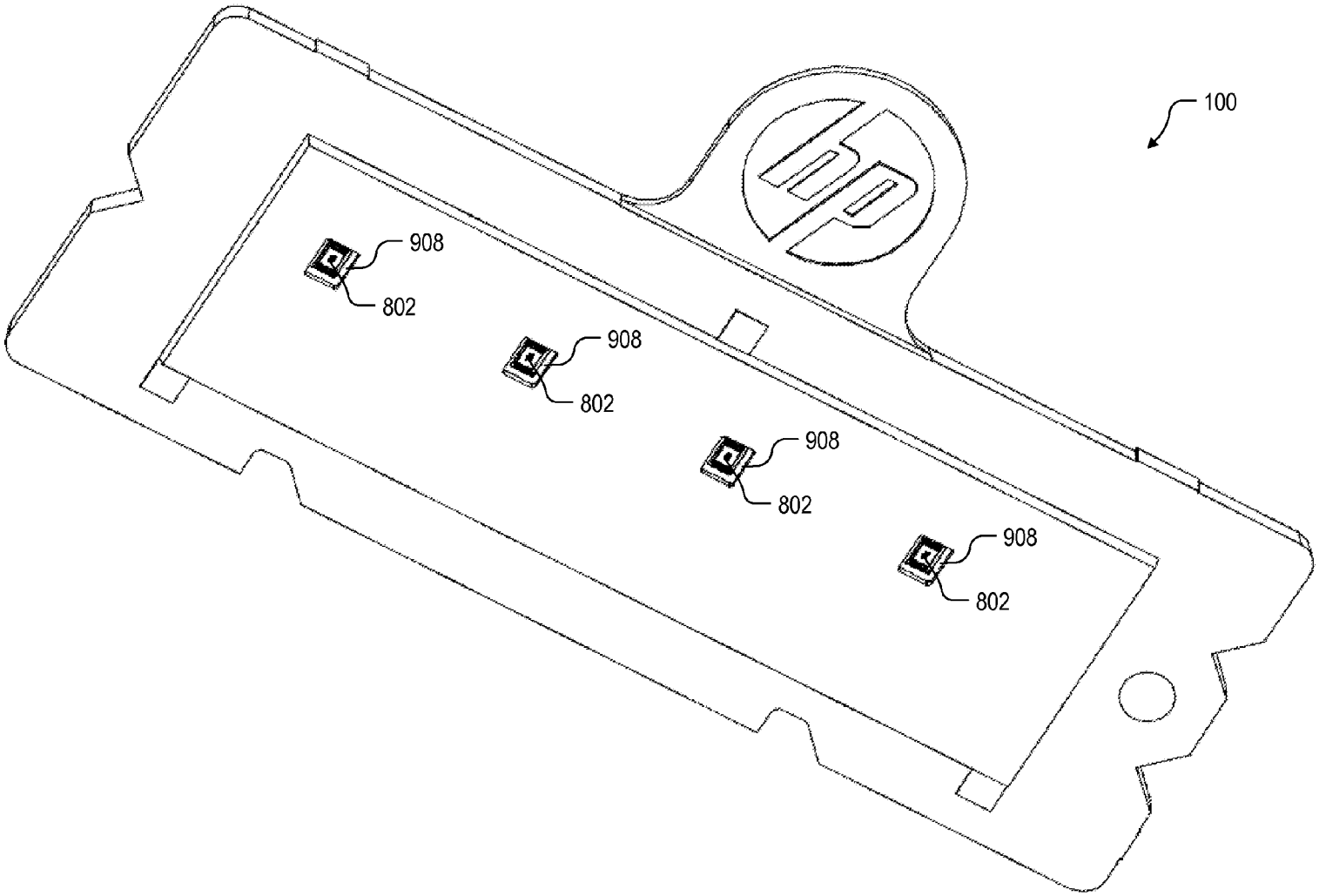
FIG. 8 is another perspective view of the cassette of FIG. 1 in one example of the present disclosure.
Figure 9:
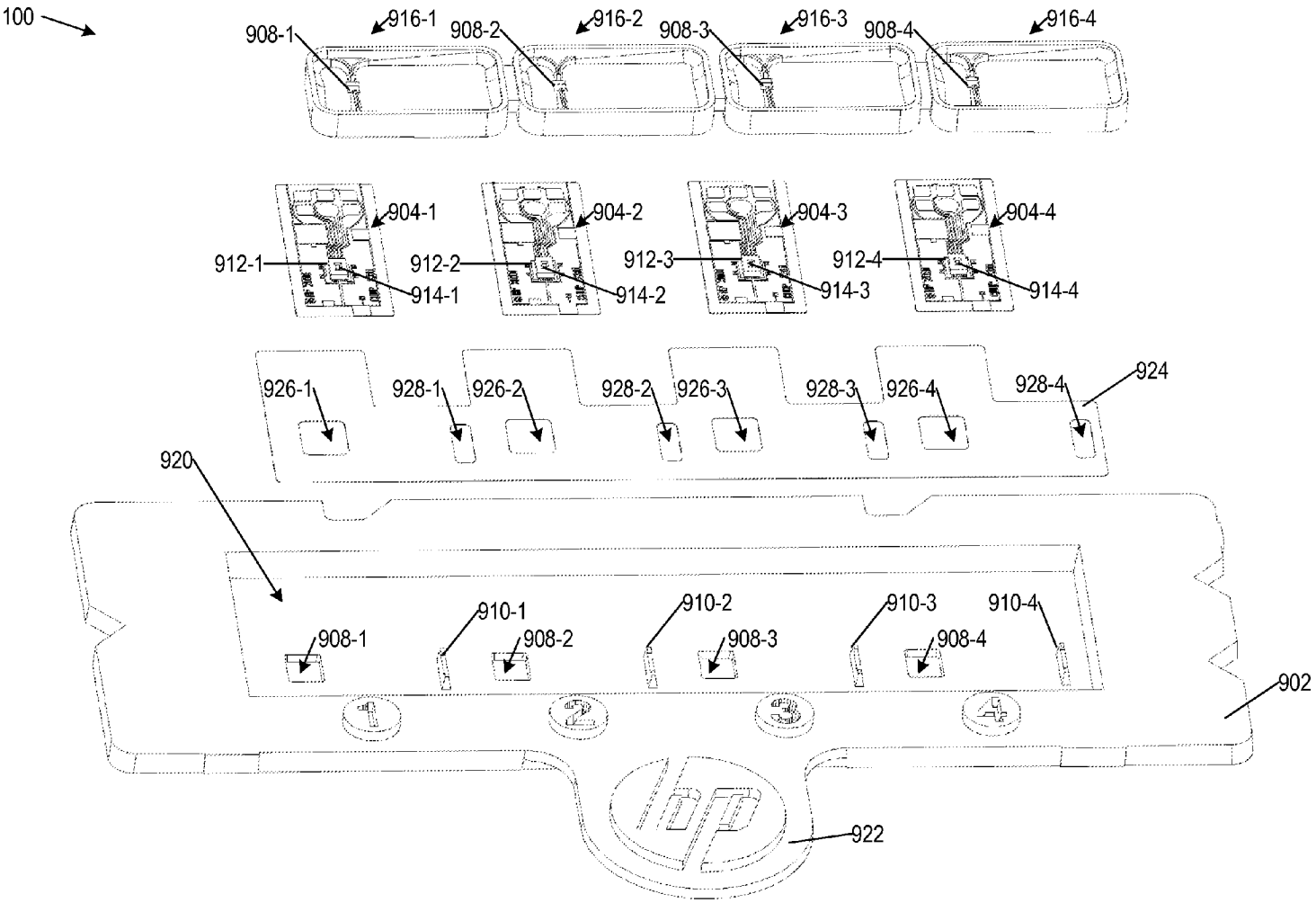
FIG. 9 is an exploded view of the cassette of FIG. 1 in one example of the present disclosure.

FIGS. 1 to 9 are various views of a liquid dispenser cassette 100 in an example of the present disclosure. Referring to FIG. 9, cassette 100 includes a frame 902, dispense head assemblies 904-1, 904-2, 904-3, and 904-4 (hereafter collectively as "dispense head assemblies 904" or individually as a generic "dispense head assembly 904"), and a one-piece integrated slot extender 906.

Frame 902 defines openings 908-1, 908-2, 908-3, and 908-4 (hereafter collectively as "openings 908" and individually as a generic "opening 908"). Frame 902 includes top alignment features 910-1, 910-2, 910-3, and 910-4 (hereafter collectively as "top alignment features 910" and individually as a generic "top alignment feature 910").

Dispense head assemblies 904-1, 904-2, 904-3, and 904-4 include respective dispense head dies 912-1, 912-2, 912-3, and 912-4 (hereafter collectively as "dispense head dies 912" and individually as a generic "dispense head die 912") to dispense fluid. Dispense head assemblies 904 are mounted on frame 902 so dispense head dies 912-1, 912-2, 912-3, and 912-4 are at least partially exposed through corresponding openings 908-1, 908-2, 908-3, and 908-4. Dispense head dies 912-1, 912-2, 912-3, and 912-4 have respective top slots 914-1, 914-2, 914-3, and 914-4 (hereafter collectively as "top slots 914" and individually as a generic "top slot 914"). Dispense head dies 912 have nozzle arrays 802 (FIG. 8) for dispensing the fluid received in top slots 914. Top slots 914 receive fluid to be dispensed through openings 908. For example the pitch of the dispense head dies 912 and/or the openings 908 corresponds to a desired or standard receptacle spacing, such as a well μlate spacing. For example the pitch is an integer multiple of 2.25 millimeters (mm)

Slot extender 906 includes reservoirs 916-1, 916-2, 916-3, and 916-4 (hereafter collectively as "reservoirs 916" and individually as a generic "reservoir 916") to hold fluids for respective dispense heads 912-1, 912-2, 912-3, and 912-4. Reservoirs 916-1, 916-2, 916-3, and 916-4 define respective drain openings 918-1, 918-2, 918-3, and 918-4 (hereafter collectively as "drain openings 918" and individually as a generic "drain opening 918").

Figure 13:
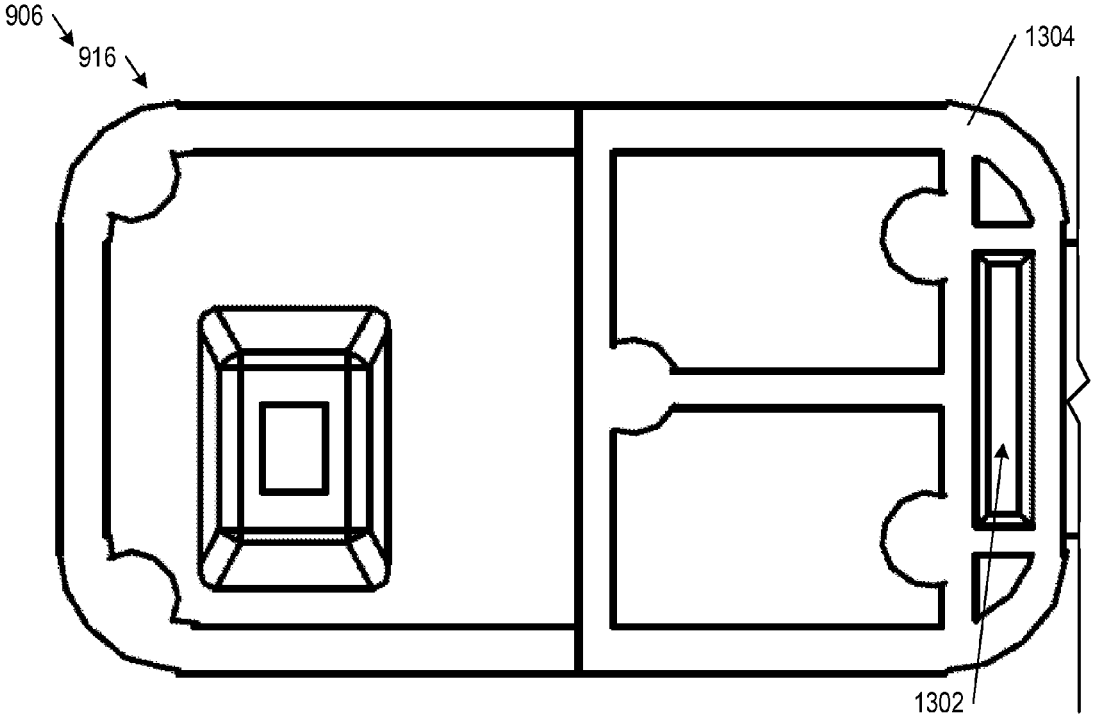
FIG. 13 is a bottom view of the reservoir of FIG. 11 in one example of the present disclosure.

Reservoirs 916 also define respective bottom alignment features 1302 (only one is shown in FIG. 13). Slot extender 906 is mounted on dispense head assemblies 904 so drain openings 918 mate to corresponding top slots 914. Slot extender 906 has bottom alignment features 1302 (FIG. 13) to mate to corresponding top alignment features 910. In one example, each reservoir 916 has a capacity equal to or greater than approximately 20 microliters (μl). In one example, each reservoir 916 has a capacity equal to or greater than approximately 100 μl. In one example, each reservoir 916 has a capacity equal to or greater than approximately 180 μl. In one example, each reservoir 916 has a capacity equal to or greater than approximately 250 μl. In one example, each reservoir 916 has a capacity of 180 to 250 μl. In one example, each reservoir 916 has a capacity equal to or greater than approximately 360 μl. In one example, each reservoir 916 has a height that ranges greater than 2.5 mm, a length greater than 1.08 mm, and a width greater than 1.48 mm. In one example, each reservoir 916 has a height that ranges from 2.5 to 5.5 mm, a length of 17 to 71 mm, and a width of 1.48 to 9.61 mm In one example, each reservoir 916 has a height of 2.5 mm, a length of 17 mm, and a width of 9.61 mm.

In one example, frame 902 defines a recess 920 for receiving dispense head assemblies 904. Openings 908 are made through recess 920, and top alignment features 910 are located in recess 920.

Figure 14:
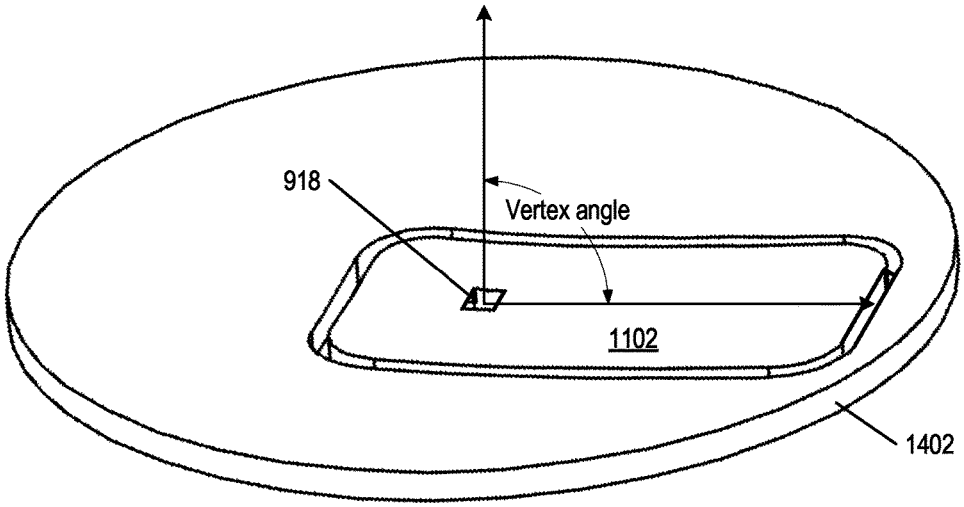
FIG. 14 illustrates a conical surface for a reservoir floor of the reservoir of FIG. 10 in one example of the present disclosure.

In one example, cassette 100 includes a preform of a pressure sensitive adhesive (PSA) 924 that is placed in recess 920 before dispense head assemblies 904. PSA 924 defines openings 926-1, 926-2, 926-3, and 926-4 (hereafter collectively as "openings 926" and individually as a generic "opening 926") that align with corresponding openings 908-1, 908-2, 908-3, and 908-4. Openings 926 may be larger than openings 908. PSA 924 defines openings 928-1, 928-2, 928-3, and 928-4 (hereafter collectively as "openings 928" and individually as a generic "opening 928") that align with corresponding top alignment features 910-1, 910-2, 910-3, and 910-4. Dispense head assemblies 904 and slot extender 906 are at least partially fixed by PSA 924. Adhesives may also be placed between drain openings 918 and top slots 914, and between alignment features 910 and 1402 (FIG. 14).

Although illustrated with four dispense head assemblies 904, cassette 100 may accommodate one to seven or greater than eight dispense head assemblies 904. Although illustrated with a single one-piece integrated slot extender 906 with four reservoirs 916, cassette 100 may use two one-piece integrated slot extenders each with two reservoirs.

In one example, frame 902 is substantially rectangular in shape but for the inclusions of a handle 922 extending from one edge and alignment cutouts along other edges. In one example, handle 922 includes a rounded edge. In one example, recess 920 and dispense head assemblies 904 are substantially rectangular in shape, dispense head assemblies 904 are oriented with their longer dimension parallel to the shorter dimension of recess 920, and dispense head assemblies 904 are evenly spaced in the longer dimension of recess 920, for example according to the earlier mentioned pitch. Slot extender 906 is mounted on dispense head dies 912 and leaves electrical contact pads 1004 (FIG. 10) exposed and accessible to a digital dispenser. For example, slot extender 906 and reservoirs 916 are oriented with their longer dimension parallel to the longer dimension of recess 920.

Figure 10:
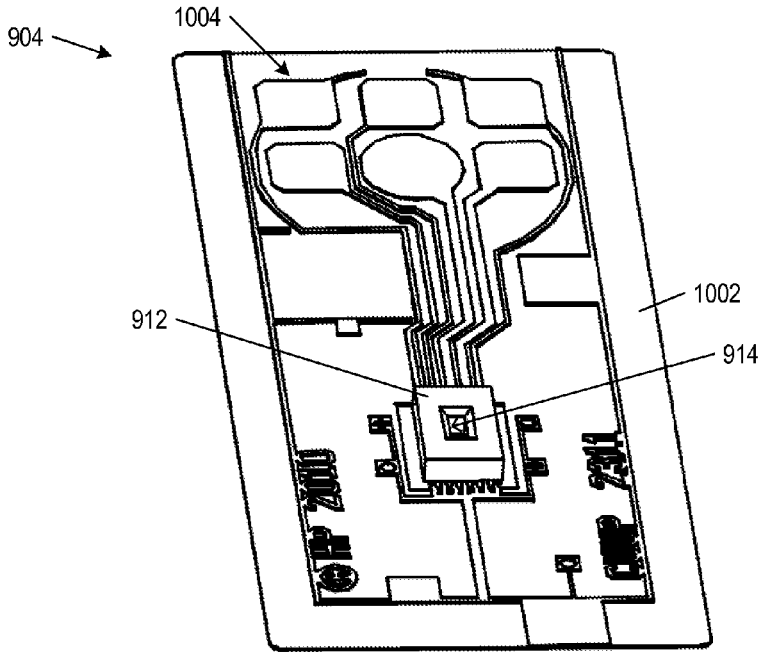
FIG. 10 is a perspective view of a dispenser head assembly in the cassette of FIG. 1 in one example of the present disclosure.

FIG. 10 is a perspective view of dispense head assembly 904 in one example of the present disclosure. Dispense head assembly 904 includes a substrate 1002, a dispense head die 912 mounted on substrate 1002, and a set of electrical contact pads 1004 on substrate 1002. Contact pads 1004 are coupled to dispense head die 912. Dispense head die 912 includes a top slot 914 that corresponds to a drain opening 918 (FIG. 9) of a reservoir 916 (FIG. 9). Referring to FIG. 8, dispense head dies 912 include downward nozzle arrays 802 exposed through corresponding openings 908.

Reservoir

Liquid may be stranded in a reservoir of a dispense head after all dispensable fluid has been depleted. This may be undesirable as it increases the cost of the material.

In examples of the present disclosure, a reservoir is provided to minimize stranded fluid. The reservoir may have ribs connecting a sidewall to a drain hole of the reservoir. A fillet may be provided where the sidewall and the ribs join a reservoir floor. The fillet may have a continuous variable radius that starts with a large radius and tapers to a smaller radius near the drain opening to pull liquid toward the drain opening.

Figure 11:
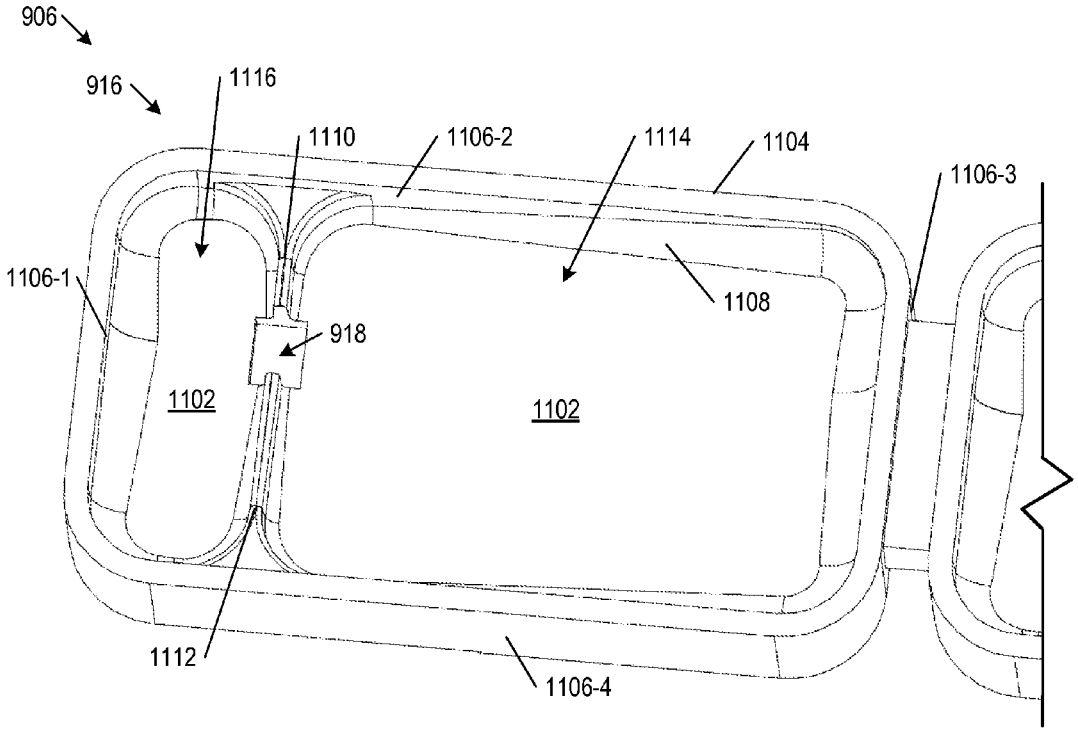
FIG. 11 is a perspective view of a reservoir of a slot extender in the cassette of FIG. 1 in one example of the present disclosure.
Figure 12:
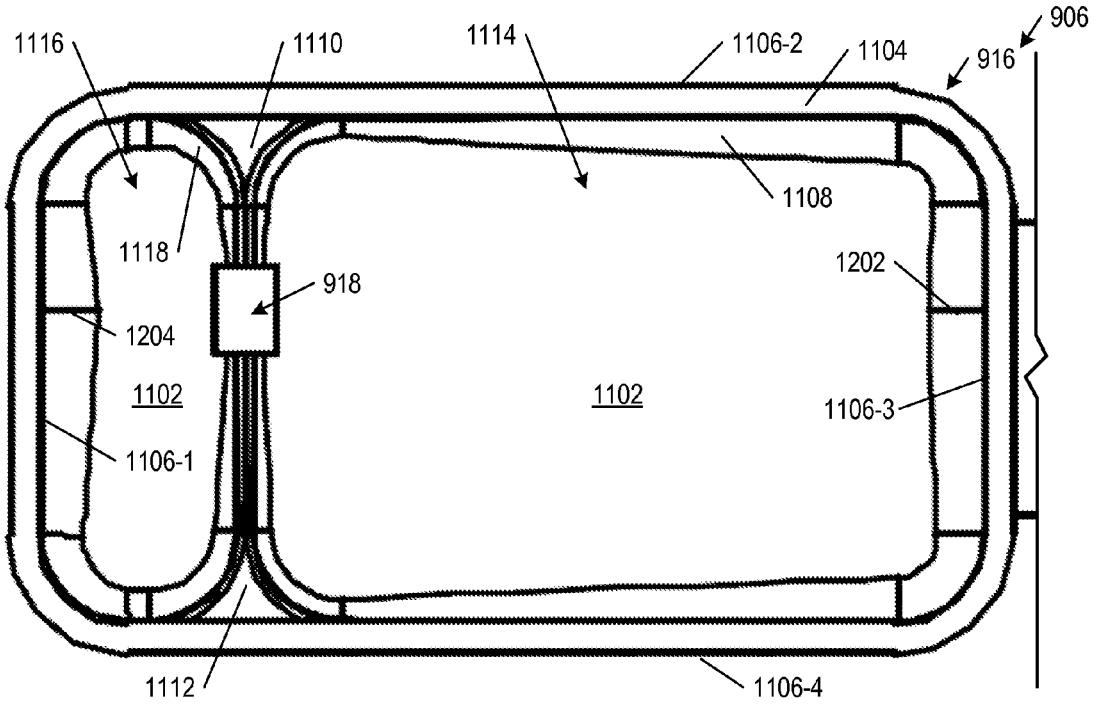
FIG. 12 is a top view of the reservoir of FIG. 11 in one example of the present disclosure.

FIGS. 11 to 13 are various views of a reservoir 916 in slot extender 906 (FIG. 9) in examples of the present disclosure. Referring to FIGS. 11 and 12, reservoir 916 has a reservoir floor 1102 defining a drain opening 918. Reservoir floor 1102 may be flat or sloped toward drain opening 918. Reservoir 916 has a continuous reservoir sidewall 1104 that extends from reservoir floor 1102 to form a container. In one example, reservoir sidewall 1104 has a rectangular shape and includes sections 1106-1, 1106-2, 1106-3, and 1106-4 joined by rounded corners. Reservoir 916 has a concave fillet 1108 running along at least a portion where reservoir sidewall 1104 joins reservoir floor 1102. Concave fillet 1108 has a continuous variable radius to pull liquid toward drain opening 918.

In one example, reservoir floor 1102 is a conical surface with a vertex centered about drain opening 918 and a vertical (plumb) axis so liquid would flow to drain opening 918 when reservoir 916 is placed on a horizontal (level) surface, such as when cassette 100 is placed in a digital dispenser. FIG. 14 is provided to illustrate how the shape of reservoir floor 1102 is obtained in one example of the present disclosure. Reservoir floor 1102 is a conical surface cut from a cone 1402 and drain opening 918 is centered about a vertex 1404 of cone 1402. In one example, conical surface 1102 has a vertex angle less than 88.5 degrees. In one example, conical surface 1102 has a vertex angle of 85 to 90 degrees. In one example, conical surface 1102 has a vertex angle of 87.5 degrees.

Referring back to FIGS. 11 and 12, in one example, reservoir 916 includes a rib 1110 extending from reservoir floor 1102 and running from reservoir sidewall section 1106-2 to drain opening 918. In this example, concave fillet 1108 also runs along where rib 1110 joins reservoir floor 1102.

In one example, reservoir 916 includes another rib 1112 extending from reservoir floor 1102 and running from the opposite reservoir sidewall section 1106-4 to drain opening 918. In this example, concave fillet 1108 further runs along where reservoir rib 1112 joins reservoir floor 1102.

Ribs 1110 and 1112 divide reservoir 916 into compartments 1114 and 1116. Compartment 1114 has concave fillet 1108 while compartment 1116 has a concave fillet 1118 with a continuous variable radius to pull liquid toward drain opening 918. Concave fillet 1118 runs along where reservoir sidewall 1104 and ribs 1110 and 1112 join reservoir floor 1102. Although two ribs 1110, 1112 are shown, reservoir 916 may include additional ribs that divide reservoir 916 into more than two compartments. For example, one additional rib may be introduced to divide reservoir 916 into three compartments, and two additional ribs may be introduced to divide reservoir 916 into four compartments.

In one example, concave fillet 1108 decreases in radius as it travels in opposite directions away from location 1202 of reservoir sidewall section 1106-3 toward drain opening 918 as shown in FIG. 12. Similarly concave fillet 1118 decreases in radius as it travels in opposite directions away from location 1204 of reservoir sidewall section 1106-1 toward drain opening 918 as shown in FIG. 12. Concave fillet 1108 and 1118 have radii that change at linear or nonlinear rates.

In one example, ribs 1110 and 1112 are shorter than reservoir sidewall 1104 so liquid can fill over ribs 1110 and 1112 in order for reservoir 916 to store a greater volume of liquid.

In one example, compartments 1114 and 1116 are the same size or different sizes. In one example, drain opening 918 is symmetrical or asymmetrically distanced from opposing reservoir sidewall sections 1106-2 and 1106-4. In one example, reservoir 916 is connected to at least another reservoir 916 in a row.

Referring to FIG. 13, a backside 1304 of reservoir 916 defines a bottom alignment feature 1302.

Figure 15:
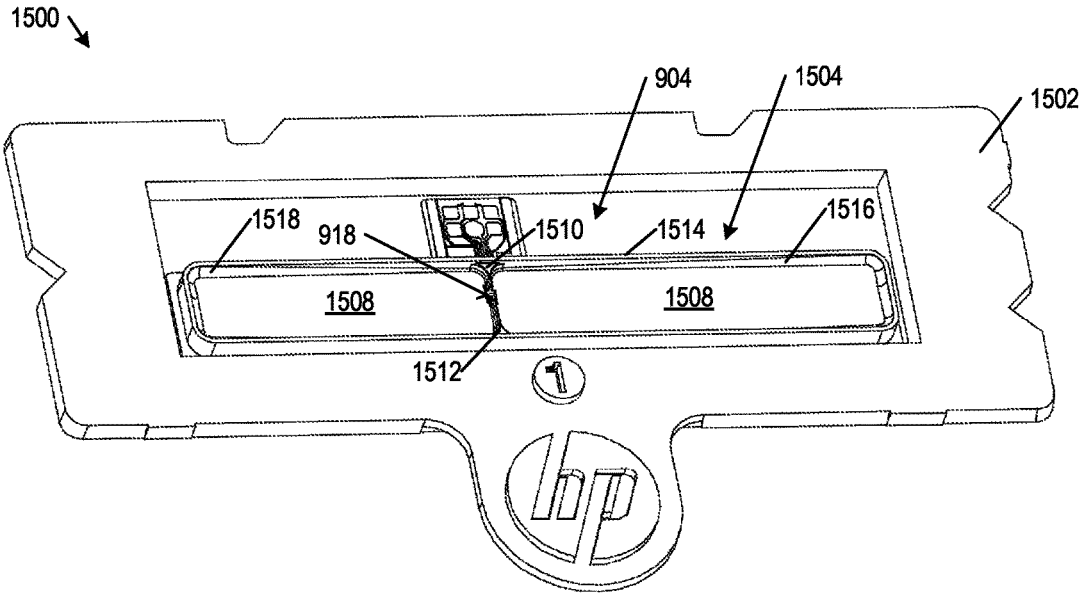
FIG. 15 illustrates a perspective view of another liquid dispenser cassette in one example of the present disclosure.

FIG. 15 illustrates a perspective view of a liquid dispenser cassette 1500 in one example of the present disclosure. Cassette 1500 includes frame 1502, a single dispense head assembly 904, and a reservoir 1504. As cassette 1500 has only one dispense head assembly 904, reservoir 1504 has a larger capacity than reservoir 916 (FIG. 9) in cassette 100 (FIG. 9).

Frame 1502 defines a single opening 908 (not visible in FIG. 15 but please see FIG. 9 for an example of the opening). Dispense head assembly 904 includes a dispense head die 912 (not visible in FIG. 15 but please see FIG. 9 for an example of the dispense head die).

Dispense head assembly 904 is mounted on frame 1502 so dispense head die 912 is at least partially exposed through opening 908. Dispense head die 912 has a top slot 914 (not visible in FIG. 15 but please see FIG. 9 for an example of the top slot). Dispense head die 912 has nozzle arrays 802 (FIG. 8) for dispensing the fluid through opening 908.

Reservoir 1504 defines a drain opening 918. Reservoir 1504 is mounted on dispense head assembly 904 so drain opening 918 mates to top slot 914. Like reservoir 916 (FIG. 9), reservoir 1504 has a reservoir floor 1508 sloped toward drain opening 918, ribs 1510 and 1512 that connect a reservoir sidewall 1514 to drain opening 918, and variable radius fillets 1516 and 1518 where ribs 1510, 1512 and reservoir sidewall 1514 join reservoir floor 1508 that pull liquid toward drain opening 918.

Reservoir 916 (FIGS. 9) and 1504 (FIG. 15) may have different configurations in other examples. In one example, the reservoir floor may include two flat or V-shaped surfaces sloped toward the drain opening. In one example, a drain opening may be located at the foot of the reservoir sidewall so there are no ribs and no compartments. In one example, the reservoir sidewall may form a perimeter of a different shape, such as a circle, oval, or a triangular shape.

Various other adaptations and combinations of features of the examples disclosed are within the scope of the invention.

What is claimed is:

1. A slot extender, comprising:
- a reservoir, comprising:
  - a reservoir floor defining a drain opening;
  - a continuous reservoir sidewall extending from the reservoir floor; and
  - a concave fillet running along at least a portion where the reservoir sidewall joins the reservoir floor, the concave fillet comprising a variable radius.

2. The slot extender of claim 1, wherein the variable radius changes at a linear or nonlinear rate.

3. The slot extender of claim 1, wherein the reservoir floor is flat or sloped toward the drain opening.

4. The slot extender of claim 1, wherein the reservoir floor comprises a conical surface centered about the drain opening.

5. The slot extender of claim 4, wherein the conical surface comprises a vertex angle less than 88.5 degrees.

6. The slot extender of claim 1, wherein the reservoir further comprises two surfaces sloped toward the drain opening.

7. The slot extender of claim 1, wherein the reservoir further comprises a rib extending from the reservoir floor and running from a section of the reservoir sidewall to the drain opening, wherein the concave fillet further runs along at least a portion where the rib joins the reservoir floor.

8. The slot extender of claim 7, wherein the reservoir further comprises:
- an other section of reservoir sidewall opposing the section of reservoir sidewall; and
- an other rib extending from the reservoir floor and running from the other section of
- the reservoir sidewall to the drain opening.

9. The slot extender of claim 8, wherein the rib and the other rib are shorter than the reservoir perimeter.

10. The slot extender of claim 8, wherein:
- the rib and the other rib divide the reservoir into first and second compartments;
- the concave fillet runs along where the rib, the other rib, and the reservoir sidewall join the reservoir floor in the first compartment; and
- the reservoir further comprises another concave fillet that runs along where the rib, the other rib, and the reservoir sidewall join the reservoir floor in the second compartment.

11. The slot extender of claim 10, wherein each concave fillet has decreasing radius as it travels toward the drain opening.

12. The slot extender of claim 11, wherein the drain opening is symmetrical or asymmetrically distanced from the reservoir sidewall and the other reservoir sidewall.

13. The slot extender of claim 1, further comprising another similar or identical reservoir connected to the reservoir in a row.

14. A reservoir, comprising:

a reservoir floor defining a drain opening;

a continuous reservoir sidewall extending from the reservoir floor;

ribs extending from the reservoir floor and running from opposing sections of the reservoir sidewall to the drain opening, the ribs dividing the reservoir into compartments;

concave fillet running along where the ribs and the reservoir sidewall join the reservoir floor in the compartments, wherein each concave fillet has decreasing radius as it travels toward the drain opening.

15. The reservoir of claim 14, wherein:

the surface comprises a conical surface centered about the drain opening;

the ribs divide the reservoir into two compartments of different sizes; and the drain opening is asymmetrically distanced from the opposing sections of the reservoir sidewall.

* * * * *